US011752496B2

(12) United States Patent
Peng

(10) Patent No.: US 11,752,496 B2
(45) Date of Patent: Sep. 12, 2023

(54) MOBILE LABORATORY FOR USE IN ENVIRONMENT TESTING

(71) Applicant: Guangdong Zhonghui Mobile Laboratory Testing Technology Co., Ltd., Guangdong (CN)

(72) Inventor: Xiaohui Peng, Guangdong (CN)

(73) Assignee: GUANGDONG ZHONGHUI MOBILE LABORATORY TESTING TECHNOLOGY CO., LTD., Guangdong (CN)

( * ) Notice: Subject to any disclaimer, the term of this patent is extended or adjusted under 35 U.S.C. 154(b) by 175 days.

(21) Appl. No.: 17/417,185

(22) PCT Filed: Aug. 20, 2020

(86) PCT No.: PCT/CN2020/110216
§ 371 (c)(1),
(2) Date: Jun. 22, 2021

(87) PCT Pub. No.: WO2022/032702
PCT Pub. Date: Feb. 17, 2022

(65) Prior Publication Data

US 2022/0323948 A1 Oct. 13, 2022

(30) Foreign Application Priority Data

Aug. 9, 2020 (CN) ..... 202010792596.9

(51) Int. Cl.
*B01L 1/00* (2006.01)
*E04H 3/08* (2006.01)

(52) U.S. Cl.
CPC ..... *B01L 1/52* (2019.08); *E04H 3/08* (2013.01); *B01L 2200/18* (2013.01); *B01L 2300/021* (2013.01); *B01L 2300/023* (2013.01)

(58) Field of Classification Search
None
See application file for complete search history.

(56) References Cited

U.S. PATENT DOCUMENTS

2020/0170865 A1* 6/2020 Maccariello ..... A61G 10/02

FOREIGN PATENT DOCUMENTS

CN 100361747 C * 1/2008
CN 101811464 A * 8/2010
(Continued)

OTHER PUBLICATIONS

International Search Report dated Apr. 28, 2021, issued in application No. PCT/CN2020/110216.
(Continued)

*Primary Examiner* — P. Kathryn Wright
(74) *Attorney, Agent, or Firm* — McClure, Qualey & Rodack, LLP

(57) ABSTRACT

The present invention discloses a mobile laboratory for use in environment testing, comprising a laboratory casing, lifting hooks are provided at four corners of a top part of an outer wall of the laboratory casing, a supporting frame is provided beneath a bottom of the laboratory casing, an testing room is provided in one side of the laboratory casing and beneficial effects are: by providing lifting hooks, it is convenient to lift and move the mobile laboratory, change orientation as per usage conditions with a transportation vehicle and to build quickly a mobile laboratory for use in the testing site; and the signal transceiver transmits testing data collected by near-infrared spectroscopy, biosensor technology, biochip detection technology, ATP bioluminescence method, immunological analysis method and immunological analysis method by QR code tags, RFID tags, cameras,
(Continued)

temperature sensors, sound sensors, vibration sensors, pressure sensors, RFID readers, QR code readers, and single-chip microcomputers.

7 Claims, 3 Drawing Sheets

(56) References Cited

FOREIGN PATENT DOCUMENTS

| | | | |
|---|---|---|---|
| CN | 102795146 | A | 11/2012 |
| CN | 202593347 | U | 12/2012 |
| CN | 107449910 | A | 12/2017 |
| CN | 209372831 | U | 9/2019 |
| CN | 211173273 | U | 8/2020 |
| JP | 09183334 | A | 7/1997 |
| RU | 65437 | U1 * | 8/2007 |

OTHER PUBLICATIONS

Written Opinion dated Apr. 28, 2021, issued in application No. PCT/CN2020/110216.

* cited by examiner

MOBILE LABORATORY FOR USE IN ENVIRONMENT TESTING

TECHNICAL FIELD

The present invention belongs to a laboratory technical field, particularly a mobile laboratory for use in environment testing.

BACKGROUND TECHNOLOGY

When an acute disease happens or when there is something wrong with air or exhaust air, it is necessary to collect samples and send to the testing department, such as a hospital or an officially designated testing place, for testing; and when there is a lot to inspect, transportation will take some time, in case the testing place is far from the incident place, it is very difficult to transport in a short time and check the samples effectively, and prior to and after testing, it is necessary for the testing staff to clean and disinfect, and it is not possible to collect and process water consumed during cleaning and disinfection, which may result in secondary pollution.

SUMMARY OF THE INVENTION

A purpose of the present invention is to address the foregoing problem.

And to address the foregoing problem, the present invention provides a following technical solution:

A mobile laboratory for use in environment testing, comprising a laboratory casing, lifting hooks are provided at four corners of a top part of an outer wall of the laboratory casing, a supporting frame is provided beneath a bottom portion of the laboratory casing, an testing room is provided in one side of the laboratory casing, a dressing room is provided at one side outside the testing room in the laboratory casing, a disinfection buffer room is provided in another side outside the testing room in the laboratory casing, and the testing room is communicated with the disinfection buffer room; door frames are provided in both sides of another side of the laboratory casing opposite to the testing room, one side of the testing room located in the disinfection buffer room, one side of the disinfection buffer room far from the testing room, and one side of the dressing room far from the testing room, sealing gaskets are provided at inner walls of the door frames, and a door body is movably connected to an inner side of each of the door frames via a door closer; ventilating mechanisms are provided between the two door frames in both sides of another side of the laboratory casing opposite to the testing room and in the testing room; water treatment mechanisms are provided in a side of the testing room and a side of the dressing room that are close to each other; a set of ultraviolet sterilization lamps are provided at a side wall of a side of the dressing room far from the water treatment mechanism; a plurality of cloth hooks are provided on a side wall of the dressing room opposite to the set of ultraviolet sterilization lamps, and a signal transceiver is provided between the two door frames at a side far from the ventilating mechanism.

Both of the ventilating mechanisms comprise a window frame and two tempered glasses, and the tempered glasses are provided in a front end and a rear end of the window frame, and the two tempered glasses are connected with the front end and the rear end of the window frame.

Preferably, the water treatment mechanism comprises a first support, bolts, a first water tank, a first water inlet, an inlet cover, a water outlet, a first pipe, a second support, a washing basin, a supporting pillar, a tap, a water injection opening, a valve, an inclined plate, a water discharging opening, a mobile cart, a second water tank, a second water inlet and a second pipe; bottom portions of both the first support and the second support are connected with an inner wall of the testing room or an inner wall of the dressing room, the first water tank is provided on top of the first support, the first water inlet is provided at a top portion of the first water tank, an outer side of the first water inlet at a side far from the first water tank is engaged with an inner side of the inlet cover by threads; the water outlet is provided at a bottom part of a front side of the first support; the washing basin is provided on top of the second support, the supporting pillar is provided at a side of a top portion of the washing basin, the tap is provided on top of the supporting pillar, the water injection opening is provided on top of the tap above the supporting pillar, both the water injection opening and the water outlet are detachably connected with both ends of the first pipe; the inclined plate is provided in the washing basin, the water discharging opening is provided in the washing basin immediately at a bottom end portion of the inclined plate, the mobile cart is provided underneath the second support in the dressing room, the second water tank is provided on the mobile cart, the second water inlet is provided on a top portion of the second water tank, and both the second water inlet and an end of the water discharging opening far from the washing basin and passing the second support are detachably connected with both ends of the second pipe.

Preferably, strengthened corrugated steel plates 2 mm thickness are welded on a top part and side walls of the laboratory casing, and strengthened corrugated steel plates 3 mm thickness are welded on a bottom part of the laboratory casing.

As a preferred solution, both the window frames in the ventilating mechanisms are made of antiseptic purification plates.

As a preferred solution, rubber planks 3 mm are paved on an inner side of a bottom portion of the laboratory casing.

As a preferred solution, all of the first water tank, the first pipe, the second pipe, the washing basin and the second water tank are made from polypropylene.

As a preferred solution, the supporting frame is made from steel with thickness of 6 mm.

As a preferred solution, the signal transceiver comprises a two-dimensional code tag, an RFID tag, a camera, a temperature sensor, a sound sensor, a vibration sensor, a pressure sensor, an RFID reader, a two-dimensional code reader, and a single-chip controller and the single-chip controller is respectively electrically connected with the two-dimensional code tag, the RFID tag, the camera, the temperature sensor, the sound sensor, the vibration sensor, the pressure sensor, the RFID reader and the two-dimensional code reader.

Beneficial Effects of the Present Invention are that:

By providing the lifting hooks, it is convenient to lift and move the mobile laboratory device in the present invention, and it is possible to change orientation as per usage conditions with a transportation vehicle and to build quickly a mobile laboratory suitable for use in the testing site;

By providing a dressing room, it is convenient for the testing staff to change clothes, and with the configuration of the ultraviolet lamps, it is possible to sterilize with ultraviolet the clothes on the cloth hooks from the testing staff, so that possibility of spread of viruses in the laboratory casing via clothes is eliminated, and in the meantime, it is more convenient for the testing staff to put on working suits;

By providing the disinfection buffer room, it is possible for the testing staff to go through thorough disinfection when entering and leaving the testing room, so that risk of escape of the hazardous gas from the testing room can be avoided;

By providing the water treatment mechanisms in both the dressing room and the testing room, it is possible to collect cleaning water used when the testing staff washes skin and gloves before and after testing, so that many potential hazards caused when water consumed is discharged without treatment can be avoided;

By providing two ventilating mechanisms, in a safe condition, space in the laboratory casing can be ventilated and problems due to bad air ventilation can be avoided;

And during testing, the signal transceiver transmits testing data collected by such as near-infrared spectroscopy, biosensor technology, biochip detection technology, ATP bioluminescence method, immunological analysis method and immunological analysis method by QR code tags, RFID tags, cameras, temperature sensors, sound sensors, vibration sensors, pressure sensors, RFID readers, QR code readers, and single-chip microcomputers.

BRIEF DESCRIPTION OF THE DRAWINGS

To ease understanding, the present invention will be further elaborated by following embodiments and accompanying drawings.

Figure 1:
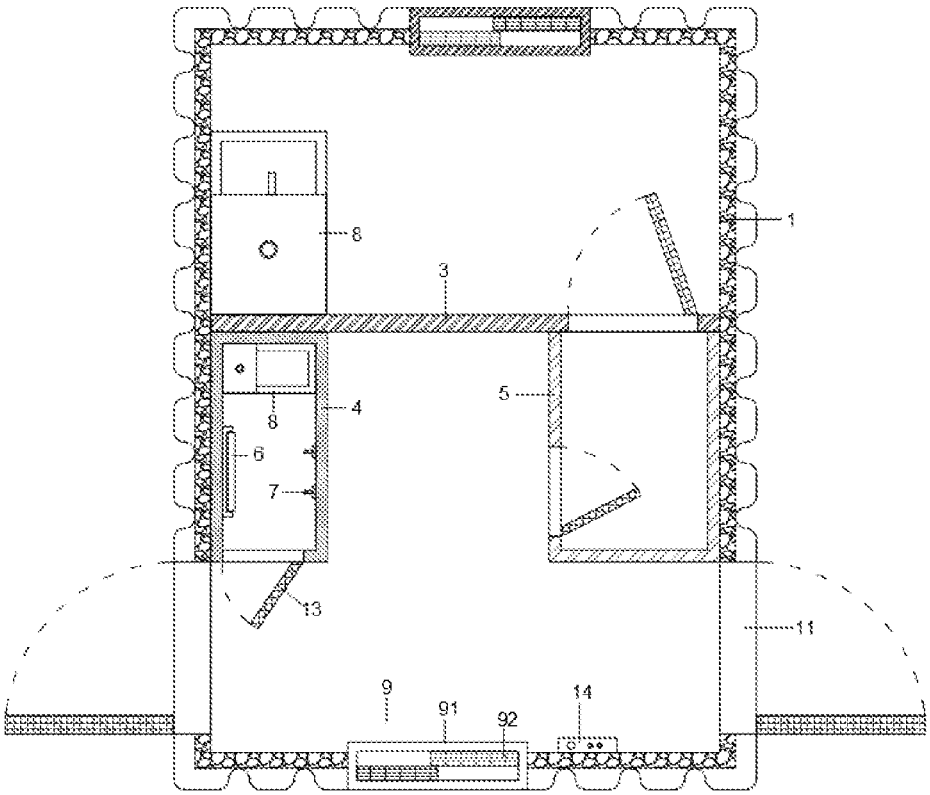
FIG. 1 is a top structural diagram of an inner side of the mobile laboratory according to the present invention.

In the drawings: 1. Laboratory casing; 2. Lifting hook; 3. Testing room; 4. Dressing room; 5. Disinfection buffer room; 6. Set of ultraviolet sterilization lamp; 7. Cloth hook; 8. Water treatment mechanism; 81. First support; 82. Bolt; 83. First water tank; 84. First water inlet; 85. Inlet cover; 86. Water outlet; 87. First pipe; 88. Second support; 89. Washing basin; 810. Supporting pillar; 811. Tap; 812. Water injection opening; 813. Valve; 814. Inclined plate; 815. Water discharging opening; 816. Mobile cart; 817. Second water tank; 818. Second water inlet; 819. Second pipe; 9. Ventilation mechanism; 91. Window frame; 92. Tempered glass; 10. Supporting frame; 11. Door frame; 12. Sealing gasket; 13. Door body; 14. Signal transceiver.

EMBODIMENTS

Figure 2:
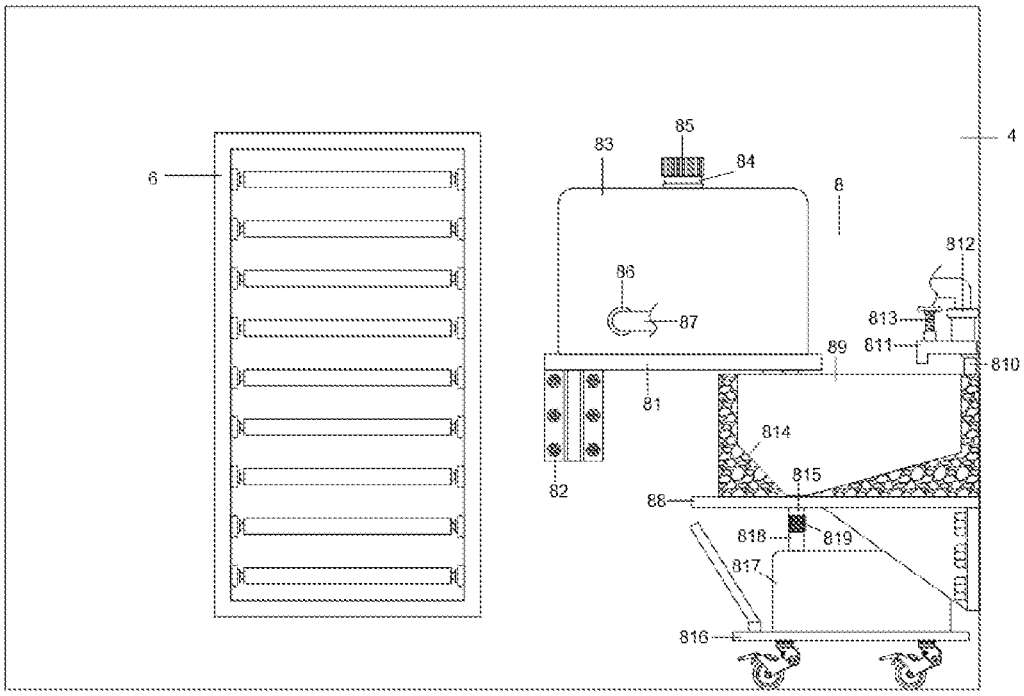
FIG. 2 is a structural diagram showing the water treatment mechanism according to the present invention.
Figure 3:
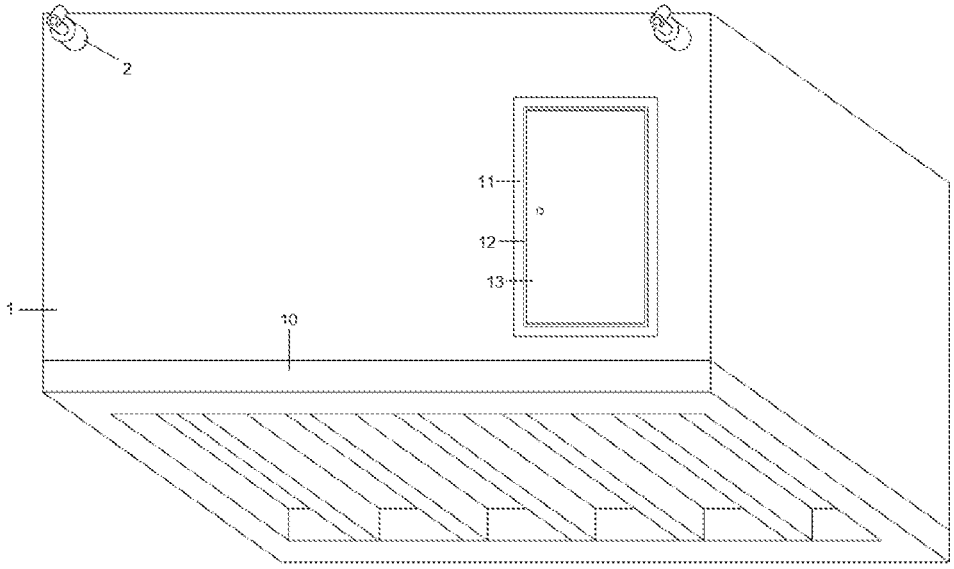
FIG. 3 is a structural diagram showing an outer side of the mobile laboratory according to the present invention.
Figure 4:
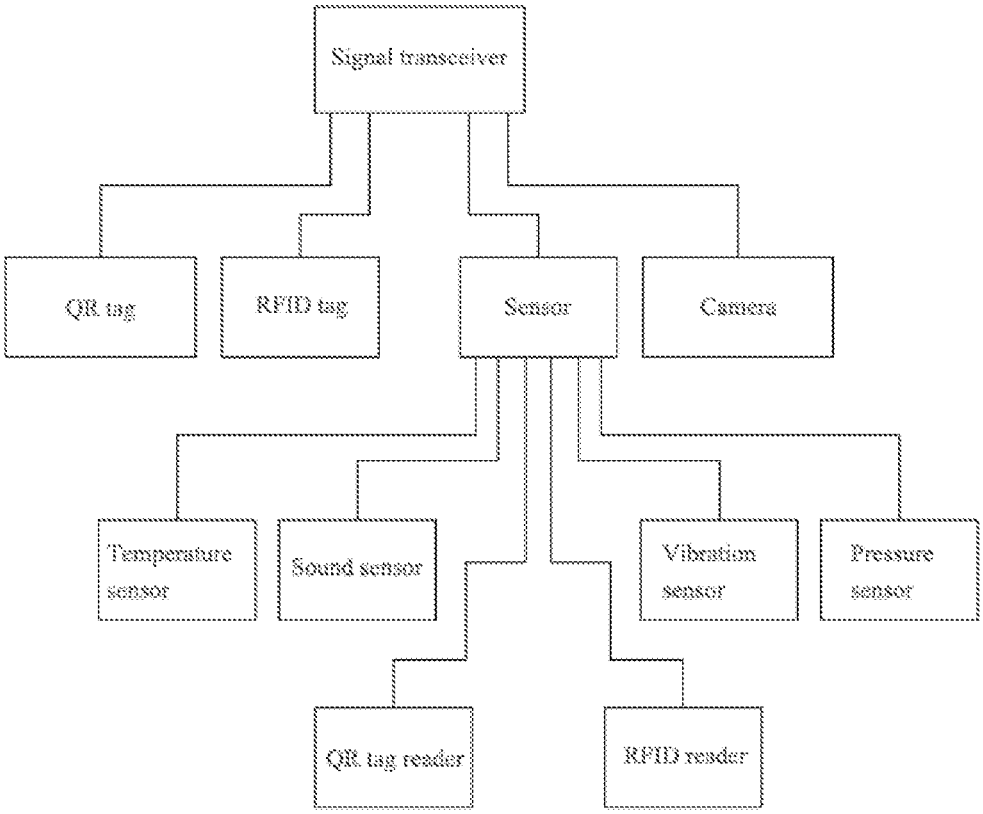
FIG. 4 is a module diagram of the signal transceiver according to the present invention.

As shown in FIG. 1 to FIG. 4, the present invention adopts the following technical solution: a mobile laboratory for use in environment testing, comprising a laboratory casing 1, lifting hooks 2 are provided at four corners of a top part of an outer wall of the laboratory casing 1, a supporting frame 10 is provided beneath a bottom portion of the laboratory casing 1, an testing room 3 is provided in one side of the laboratory casing 1, a dressing room 4 is provided at one side outside the testing room 3 in the laboratory casing 1, a disinfection buffer room 5 is provided in another side outside the testing room 3 in the laboratory casing 1, and the testing room 3 is communicated with the disinfection buffer room 5; door frames 11 are provided in both sides of another side of the laboratory casing 1, one side of the testing room 3 located in the disinfection buffer room 5, one side of the disinfection buffer room 5 far from the testing room 3, and one side of the dressing room 4 far from the testing room 3, sealing gaskets 12 are provided at inner walls of the door frames 11, and a door body 13 is movably connected to an inner side of each of the door frames 11 via a door closer; ventilating mechanisms 9 are provided between the two door frames 11 and in the testing room 3, water treatment mechanisms 8 are provided in a side of the testing room 3 and a side of the dressing room 4 that are close to each other; a set of ultraviolet sterilization lamps 6 are provided at a side wall of a side of the dressing room 4 far from the water treatment mechanism 8; a plurality of cloth hooks 7 are provided on a side wall of the dressing room 4 opposite to the set of ultraviolet sterilization lamps 6, a signal transceiver 14 is provided between two door frames 11 at a side far from the ventilating mechanism 9.

Both of the ventilating mechanisms 9 comprise a window frame 91 and two tempered glasses 92, and the tempered glasses 92 are provided in a front end and a rear end of the window frame 91, and the two tempered glasses 92 are connected with the front end and the rear end of the window frame 91.

Wherein, the water treatment mechanism 8 comprises a first support 81, bolts 82, a first water tank 83, a first water inlet 84, an inlet cover 85, a water outlet 86, a first pipe 87, a second support 88, a washing basin 89, a supporting pillar 810, a tap 811, a water injection opening 812, a valve 813, an inclined plate 814, a water discharging opening 815, a mobile cart 816, a second water tank 817, a second water inlet 818 and a second pipe 819; bottom portions of both the first support 81 and the second support 82 are connected with an inner wall of the testing room 3 or an inner wall of the dressing room 4, the first water tank 83 is provided on top of the first support 81, the first water inlet 84 is provided at a top portion of the first water tank 83, an outer side of the first water inlet 84 at a side far from the first water tank 83 is connected with an inner side of the inlet cover 85 by threads; the water outlet 86 is provided at a bottom part of a front side of the first support 81; the washing basin 89 is provided on top of the second support 88, the supporting pillar 810 is provided at a side of a top portion of the washing basin 89, the tap 811 is provided on top of the supporting pillar 810, the water injection opening 812 is provided on top of the tap 811 above the supporting pillar 810, both the water injection opening 812 and the water outlet 86 are detachably connected with both ends of the first pipe 87; the inclined plate 814 is provided in the washing basin 89, the water discharging opening 815 is provided in the washing basin 89 immediately at a bottom end portion of the inclined plate 814, the mobile cart 816 is provided underneath the second support 88 in the dressing room 4, the second water tank 817 is provided on the mobile cart 816, the second water inlet 818 is provided on a top portion of the second water tank 817, and both the second water inlet 818 and an end of the water discharging opening 815 far from the washing basin 89 and passing the second support 88 are detachably connected with both ends of the second pipe 819.

Preferably, strengthened corrugated steel plates 2 mm thickness are welded on a top part and side walls of the laboratory casing 1, and strengthened corrugated steel plates 3 mm thickness are welded on a bottom part of the laboratory casing 1.

Wherein, both the window frames 91 in the ventilating mechanisms 9 are made of antiseptic purification plates.

Wherein, rubber planks 3 mm are paved on an inner side of a bottom portion of the laboratory casing 1.

Wherein, all of the first water tank 83, the first pipe 87, the second pipe 819, the washing basin 89 and the second water tank 817 are made from polypropylene.

Wherein, the supporting frame 10 is made from steel with thickness of 6 mm.

Wherein, the signal transceiver 14 comprises a two-dimensional code tag, an RFID tag, a camera, a temperature sensor, a sound sensor, a vibration sensor, a pressure sensor, an RFID reader, a two-dimensional code reader, and a single-chip controller and the single-chip controller is respectively electrically connected with the two-dimensional code tag, the RFID tag, the camera, the temperature sensor, the sound sensor, the vibration sensor, the pressure sensor, the RFID reader and the two-dimensional code reader.

Specifically: after entering the laboratory casing 1, the testing staff goes into the dressing room 4, takes off ordinary clothes, puts the same on the cloth hooks 7, puts on working suits for the testing room, turns on the set of ultraviolet sterilization lamps 6 for ultraviolet disinfection, enters the disinfection buffer room 5 after putting on the working suits, and makes disinfection before going into the testing room 3; spraying disinfection tools can be provided in the disinfection buffer room 5, thereafter the testing staff enters the testing room 3 after disinfection, washes hands with the water treatment mechanism 8 provided in the testing room 3, and makes sample testing work after completing washing; after testing, cleans the gloves when gloves are worn or hands when no gloves are worn with the water treatment mechanism 8 again, after cleaning, enters the disinfection buffer room for disinfection before leaving, finally goes to the dressing room 4, takes off the working suits, hangs the same on the cloth hooks 7, disinfects the working suits with the set of ultraviolet sterilization lamps 6, cleans arms or exposed skin, and puts on the ordinary clothes.

During cleaning, by opening the valve 813, water in the first tank 83 passes the water outlet 86, the first pipe 87, the water injection opening 812 and the tap 811 and enters the washing basin 89, so cleaning can be done; cleaning water passes the water discharging opening 815, the second pipe 819 and the second water inlet 818 and enters the second water tank 817, so all cleaning water is collected in the second water tank 817; the first water tank 83 can be supplied via the first water inlet 84, and when the second water tank 817 is nearly filled with water, extract the lower end of the second pipe 819 from the second water inlet 818, and move the second water tank 817 with the mobile cart 816 for treatment of the used water.

During testing, the signal transceiver 14 can be used for data transmission, the signal transceiver 14 comprises QR code tags, RFID tags, cameras and sensors for information collection and acquisition, wherein the sensors comprise temperature sensors, sound sensors, vibration sensors, pressure sensors, RFID readers and QR code readers etc.

Primary fast testing technologies for collecting initial data comprise:

1) Near infrared spectroscopy: hydrogen-containing groups in the test samples absorb selectively infrared light of different frequencies and by analyzing optical density of transmitted or reflected light with detectors, content of the hydrogen-containing groups can be determined, which is always used in online production analysis.
2) Biosensor technology: biosensor technology is characterized by being of diversified functions, small in size, intelligent, integrated, cheap, highly sensitive, of high recognition capacity, and very practical.
3) Biochip: biochip is characterized in being highly automated, capable of detecting a plurality of target molecules, very fast, and short in detection cycle etc., and biochip is used in such as food safety and disease diagnosis fields, and has attracted many concerns internationally.
4) ATP bioluminescence: ATP bioluminescence is a fast detection method for checking food crystallinity and is developing rapidly these years. Fast and good effects can be achieved when the ATP bioluminescence detection technology is used in bacterial pollution condition test of meat products or checking surface hygiene conditions of food utensils.
5) Immunological analysis method: technical principles of immunological technology are to detect by specific binding reaction of antigen and antibodies, supplemented by immune-amplification technology. The immunological analysis method is characterized in being highly specific, accurate and fast, and can be used in detecting pesticide and veterinary drug residues, detecting pathogenic bacteria, toxins and genetically modified genes and main detecting instruments used are enzyme-linked immunoassays and automatic chemiluminescence analyzers, which can detect simultaneously 120 samples and 15 items, and improve detection efficiency remarkably. The most commonly used immunoassay kits in primary laboratories are such as: clenbuterol enzyme-linked immunoassay kits, chemiluminescence immunoassay kits for chloramphenicol.
6) Rapid paper strip method: currently there are many rapid paper strips available for measuring microorganism, veterinary drug residues and illegal additives, such as rapid detection paper strips for colloid gold of chemical contaminants, such as β-stimulants, β-lactam antibiotics, sulfa antibiotics and melamine, by which detection can be completed quickly and easily. By a reading instrument the detection results can be read and stored.

The above shows and describes the basic principles and main features of the present invention and the advantages of the present invention. Those skilled in the art should understand that the present invention is not limited by the above-mentioned embodiments. The above-mentioned embodiments and the description in the specification are only illustrative of the present invention. In principle, without departing from the spirit and scope of the present invention, the present invention will have various changes and improvements. These changes and improvements fall within the scope of the claimed invention. The claimed scope of the present invention is determined by the appended claims and their equivalents.

The invention claimed is:

1. A mobile laboratory for use in environment testing, comprising a laboratory casing (1), lifting hooks (2) are provided at four corners of a top part of an outer wall of the laboratory casing (1), a supporting frame (10) is provided beneath a bottom portion of the laboratory casing (1), an testing room (3) is provided in one side of the laboratory casing (1), a dressing room (4) is provided at one side outside the testing room (3) in the laboratory casing (1), a disinfection buffer room (5) is provided in another side outside the testing room (3) in the laboratory casing (1), and the testing room (3) is communicated with the disinfection buffer room (5); door frames (11) are provided in both sides of another side of the laboratory casing (1), one side of the testing room (3) located in the disinfection buffer room (5), one side of the disinfection buffer room (5), and one side of the dressing room (4), sealing gaskets (12) are provided at inner walls of the door frames (11), and a door body (13) is movably connected to an inner side of each of the door frames (11) via a door closer; ventilating mechanisms (9) are provided between the two door frames (11) and in the testing room (3), water treatment mechanisms (8) are provided in a side of the testing room (3) and a side of the dressing room (4) that are close to each other; a set of ultraviolet sterilization lamps (6) are provided at a side wall of the dressing room (4); a plurality of cloth hooks (7) are provided on a side wall of the dressing room (4) opposite to the set of ultraviolet sterilization lamps (6), a signal transceiver (14) is provided between two door frames (11);

both of the ventilating mechanisms (9) comprise a window frame (91) and two tempered glasses (92), and the tempered glasses (92) are provided in a front end and a rear end of the window frame (91), and the two tempered glasses (92) are connected with the front end and the rear end of the window frame (91);

the water treatment mechanism (8) comprises a first support (81), bolts (82), a first water tank (83), a first water inlet (84), an inlet cover (85), a water outlet (86), a first pipe (87), a second support (88), a washing basin (89), a supporting pillar (810), a tap (811), a water injection opening (811), a valve (813), an inclined plate (814), a water discharging opening (815), a mobile cart (816), a second water tank (817), a second water inlet (818) and a second pipe (819); bottom portions of both the first support (81) and the second support (82) are connected with an inner wall of the testing room (3) or an inner wall of the dressing room (4), the first water tank (83) is provided on top of the first support (81), the first water inlet (84) is provided at a top portion of the first water tank (83), an outer side of the first water inlet (84) is connected with an inner side of the inlet cover (85) by threads; the water outlet (86) is provided at a bottom part of a front side of the first support (81); the washing basin (89) is provided on top of the second support (88), the supporting pillar (810) is provided at a side of a top portion of the washing basin (89), the tap (811) is provided on top of the supporting pillar (810), the water injection opening (812) is provided on top of the tap (811) above the supporting pillar (810), both the water injection opening (812) and the water outlet (86) are detachably connected with both ends of the first pipe (87); the inclined plate (817) is provided in the washing basin (89), the water discharging opening (815) is provided in the washing basin (89) immediately at a bottom end portion of the inclined plate (814), the mobile cart (816) is provided underneath the second support (88) in the dressing room (4), the second water tank (817) is provided on the mobile cart (816), the second water inlet (818) is provided on a top portion of the second water tank (817), and both the second water inlet (818) and an end of the water discharging opening (815) passing the second support (88) are detachably connected with both ends of the second pipe (819).

2. The mobile laboratory for use in environment testing according to claim 1, wherein, strengthened corrugated steel plates 2 mm thickness are welded on a top part and side walls of the laboratory casing (1), and strengthened corrugated steel plates 3 mm thickness are welded on a bottom part of the laboratory casing (1).

3. The mobile laboratory for use in environment testing according to claim 1, wherein, both the window frames (91) in the ventilating mechanisms (9) are made of antiseptic purification plates.

4. The mobile laboratory for use in environment testing according to claim 1, wherein, rubber planks 3 mm are paved on an inner side of a bottom portion of the laboratory casing (1).

5. The mobile laboratory for use in environment testing according to claim 1, wherein, all of the first water tank (83), the first pipe (87), the second pipe (819), the washing basin (89) and the second water tank (817) are made from polypropylene.

6. The mobile laboratory for use in environment testing according to claim 1, wherein, the supporting frame (10) is made from steel with thickness of 6 mm.

7. The mobile laboratory for use in environment testing according to claim 1, wherein, the signal transceiver (14) comprises a two-dimensional code tag, an RFID tag, a camera, a temperature sensor, a sound sensor, a vibration sensor, a pressure sensor, an RFID reader, a two-dimensional code reader, and a single-chip controller and the single-chip controller is respectively electrically connected with the two-dimensional code tag, the RFID tag, the camera, the temperature sensor, the sound sensor, the vibration sensor, the pressure sensor, the RFID reader and the two-dimensional code reader.

* * * * *